United States Patent [19]

Stern et al.

[11] 4,447,568

[45] May 8, 1984

[54] FLAME-RETARDANT POLYACRYLONITRILE FIBER

[75] Inventors: Gerhard Stern, Linz; Klaus Weinrotter, Vöcklabruck, both of Austria

[73] Assignees: Chemie Linz AG, Linz; Chemiefaser Lenzing AG, Lenzing, both of Austria

[21] Appl. No.: 493,333

[22] Filed: May 10, 1983

[30] Foreign Application Priority Data

May 19, 1982 [AT] Austria ..... 1979/82

[51] Int. Cl.[3] ..... C08K 5/34

[52] U.S. Cl. ..... 524/101; 524/406; 524/412; 524/417; 524/432; 524/436; 524/456

[58] Field of Search ..... 524/100, 101, 406, 412, 524/432; 525/359.2

[56] References Cited

U.S. PATENT DOCUMENTS

| | | | |
|---|---|---|---|
| 3,271,344 | 9/1966 | Lowes, Jr. | 524/412 |
| 3,480,582 | 11/1969 | Brooks | 524/412 |
| 3,959,219 | 5/1976 | Aoyama et al. | 524/101 |
| 4,187,377 | 2/1980 | Narisawa et al. | 524/100 |
| 4,215,085 | 7/1980 | Gomez | 524/101 |
| 4,331,780 | 5/1982 | Brady | 524/101 |

FOREIGN PATENT DOCUMENTS

| | | |
|---|---|---|
| 284327 | 9/1970 | Austria . |
| 5496 | 7/1981 | European Pat. Off. . |
| 2244543 | 8/1974 | Fed. Rep. of Germany . |
| 1459383 | 12/1976 | United Kingdom . |

*Primary Examiner*—John Kight, III
*Assistant Examiner*—R. A. White
*Attorney, Agent, or Firm*—Mark Dryer

[57] ABSTRACT

A polyacrylonitrile fiber which has flame-retardant properties, is produced by dry spinning, has an acrylonitrile content of at least 85% by weight in the parent polymer and contains as flame retarder 15 to 40% by weight of tris-2,3-dibromopropyl isocyanurate, based on the polymer. The flame-retardant effect can be further increased by a content of up to 10% by weight of one or more synergistic compounds.

8 Claims, No Drawings

FLAME-RETARDANT POLYACRYLONITRILE FIBER

The present invention relates to a dry-spun polyacrylonitrile fiber which has permanent flame-retardant properties and to a process for its production via a conventional dry-spinning method.

Because of their pleasant hand and high bulking ability, polyacrylonitrile fibers are considered the most wool-like synthetic fibers. The excellent light and weathering fastness, good crease recovery, excellent dye-ability, easy care properties and good chemical stability are the reasons why acrylic fibers are extensively used in the home furnishings sector as well as in apparel. It is exactly these areas of use which make topical the demand for these fibers, which are readily ignitable and continue to burn by themselves, to be given a flame-retardant finish while retaining the above-mentioned, good properties.

A frequently used way of achieving this objective is to use copolymers of acrylonitrile with halogen-containing comonomers to prepare the fiber, the acrylonitrile content in the fiber being reduced to as low a level as 50% by weight. Such fibers, the so-called modacrylic fibers, have, however, properties different from those of conventional polyacrylonitrile fiber, which, according to DIN No. 60,001, has an acrylonitrile content of at least 85% by weight. For instance, the wool-like hand is usually lost, the fibers' inherent whiteness and UV stability are reduced, and the fibers tend to lose their luster in the course of hot-wet treatments. Because of their lower thermostability, modacrylics are usually produced by a wet-spinning method. Dry spinning with the drying gas at customary temperatures of 200° to 300° C. yellows the fiber.

It has already been proposed (Austrian Pat. No. 284,327) to give polyacrylonitrile fibers a flame-retardant finish by adding halogenated compounds which contain as much aromatically bonded bromine or chlorine as possible, but it is also necessary to add a solid high-melting water-insoluble phosphine compound or an antimony compound, such as antimony trioxide, to obtain an adequate flame-retardant effect. Also examined were compounds having aliphatically bonded bromine, but they were rejected as unsuitable because of high leaching losses. In this patent, the fibers were likewise prepared by a wet-spinning method and the recommended amounts of added halogenated compound were less than 10% by weight, higher added amounts said to be inadvisable, since the fiber properties would be too much impaired as a result. However, this Austrian patent specification contains no information on the whiteness, hand or tenacity of the fibers finished with low levels of additive. Similarly, this patent specification only says how much additive is lost in drying the fiber, in steaming at 130° C. and in a one hour boil in water, but not how much of the additive has already been lost during the preparation of the fiber. But it is exactly here where the largest loss of additive is incurred.

Another precondition for use in a dry-spinning method is that at the high spinning gas temperatures of about 200° to 300° C. the additive neither decomposes nor sublimes nor melts. The final requirement for use is that the additive content is resistant not only to washing but also to dry cleaning. These requirements were hitherto not met by additives which give adequate flame retardancy without significantly impairing fiber properties.

German Auslegeschrift No. 2,244,543 discloses that tris-2,3-dibromopropyl isocyanurate is a suitable flame retardant for various plastics, including acrylic resins, since it is soluble in lower monomeric acrylates and methacrylates and can therefore be added before the polymerization.

British Pat. No. 1,459,383 contains the further information that this compound has a special position in the flameproofing of polypropylene, since it, together with antimony trioxide as a synergist, develops excellent flame-retardant properties in amounts as low as 2 to 7% by weight, based on the polymer. In contrast, to finish other polymers, such as, for example, polyethylene, polystyrene or ABS, significantly higher amounts of this bromine compound need to be added to obtain barely acceptable flame-retardant properties.

In European Pat. No. 0,005,496 tris-2,3-dibromopropyl isocyanurate, together with antimony trioxide and certain organotin compounds, is also used for the production of a flame-retardant polypropylene fiber. Here the bromine compound is added in amounts of 0.5 to 10% by weight. However, it is preferred to use only about 3% by weight of this compound, and it is also stressed in this patent that these low added amounts have the advantage that fiber properties are hardly affected.

We have now found, surprisingly, that dry-spun polyacrylonitrile fibers can be given a flame-retardant finish by adding 15 to 40% by weight of tris-2,3-dibromopropyl isocyanurate, contrary to any expectation the high level of additive hardly affecting fiber properties, if at all, and, above all, the wool-like hand being fully retained. The suitability of this bromine compound as an additive in the production of dry-spun polyacrylonitrile fiber is very surprising, since the compound has a melting point of 90° C. Yet there is no sign of melting, despite the high temperatures in the spinning cell, nor is there significant loss of this bromine compound. This state of affairs and the fact that this compound, in spite of its solubility in perchloroethylene, is very stable in the fiber to dry cleaning and finally the fact that in spite of the compound being readily soluble in dimethylformamide there are only small losses of bromine compound (at most 2 to 3%) in the stretching bath and in the wash treatment suggest that tris-2,3-dibromopropyl isocyanurate is somehow chemically bonded to the polyacrylonitrile or to one of the copolymers used. This inference is supported by the fact that in differential thermal analysis of the fiber a melting of tris-2,3-dibromopropyl isocyanurate is no longer detectable.

The present invention accordingly relates to a flame-retardant polyacrylonitrile fiber comprising a parent polymer with an acrylonitrile content of at least 85% by weight and 15 to 40% by weight based on the polymer of tris-2,3-dibromopropyl isocyanurate, said fiber being prepared by the so called "dry spinning method". The fiber preferably contains 25 to 40% by weight of this bromine compound.

The flame-retardant properties of tris-2,3-dibromopropyl isocyanurate can be further increased by adding up to 10% by weight, based on the polymer content, of one or more synergistic compounds, examples of such synergists being oxides or compounds of antimony, bismuth, molybdenum, phosphorus, zinc or magnesium. The amount of these synergists is preferably 2 to 6% by weight. The oxides of antimony, especially antimony trioxide, and molybdenum compounds have particularly powerful synergistic actions in this context. However, zinc compounds, such as zinc oxide or zinc phosphate, and magnesium oxide are also noteworthy.

It is particularly preferable to use mixtures of two synergists, of which one is an oxide or a compound which has the characteristics of a base. This has the advantage that the basic synergistic compound at the same time acts as an acid acceptor for the small amounts of hydrogen bromide which can form in the course of fiber production, and can hence effectively counteract any sign of corrosion on the spinning pumps, spinnerets and the like. The UV stability is also raised thereby. Particularly suitable basic synergists have been found to be zinc oxide and alkaline magnesium compounds, which are especially used in such mixtures with antimony oxides, molybdenum oxides or molybdenum compounds in which the antimony or molybdenum component content predominates. Preferably the total synergist content is 6% by weight, and that of basic compounds, such as zinc oxide, present in the mixture 2% by weight.

If desired, the fiber can of course also contain a conventional acid acceptor which develops no synergism with tris-2,3-dibromopropyl isocyanurate. Noteworthy examples of such acid acceptors are epoxides, such as 1-bromo-2,3-epoxypropane, 1,2-epoxydecane, 1,2-epoxydodecane or 2,3-epoxypropanol. Other customary additives, such as, for example, optical brighteners or light stabilizers and the like, can also be present.

The flame-retardant polyacrylonitrile fibers of the invention are prepared in a customary manner by the so called "dry spinning method", the flame-retardant bromine compounds, any Synergists, if present, and the other additives being added during or after the preparation of the spinning solution. The spinning solution is preferably prepared with dimethylformamide as solvent. For example, the additives can be dissolved or suspended in dimethylformamide together with the polymer or be added to the solution of the polymer during or immediately after the dissolving step in such amounts that the additive content required by the invention results.

It is advisable to add the bromine compound and the synergists as late as possible, preferably immediately before the fiber is spun, since in conventional manufacture the spinning solution has to be held at elevated temperatures for a prolonged period, and this could give rise to losses of the bromine compound by elimination of HBr. This addition is best carried out in the form of a masterbatch, ie. the tris-2,3-dibromopropyl isocyanurate and the synergist(s) are first homogeneously mixed with small amounts of dimethylformamide and polyacrylonitrile and then added to the spinning solution, where homogeneous mixing is easily accomplished by means of static or dynamic mixers.

Spinning presents no problems, since tris-2,3-dibromopropyl isocyanurate is readily soluble in dimethylformamide and for this reason only the relatively small amount of synergists, if any are used, is present in the spinning solution in suspended form. Furthermore, the elimination of HBr due to heating takes place only to a very small extent in the preparation of the spinning solution. The extent of this elimination can be easily brought under control by adding, as mentioned earlier, a basic synergist, so that there are no corrosion problems at the spinnerets or the like.

It is advisable to mix the solution thoroughly when the combination of additives has been added.

Regardless of where or when the additive(s) is or are added, the spinning solution is prepared in the manner customary for the dry-spinning method; namely, the polymer is conventionally suspended, and dissolved, and the solution is deaerated, filtered and raised to the customary spinning temperature. In most cases, this temperature is between about 70° and 120° C. Spinning can be carried out with customary spinning gas temperatures in the upper part of the spinning cell of 180° to 320° C.

Nor do the subsequent steps for aftertreating the fiber, such as bath-stretching, washing, soft-finishing, drying, stuffer box crimping, steaming or cutting into staple fiber, differ from the customary procedure for polyacrylonitrile fibers.

The flame-retardant properties of the finished fiber are ascertained, on the one hand, by determining the limiting oxygen index (LOI) in accordance with ASTM D 2863 and, on the other, in accordance with DIN No. 53,906 by exposing to a flame the edge of knitted as well as of woven fabrics, the quantities measured being the burning time after 3 seconds continuous exposure to a flame, the burning time after 15 seconds of continuous exposure to a flame and, after the sample has been removed from the test rig, the tear length, which indicates the extent to which the sample has been destroyed.

The LOI values show that the fiber of the invention has a flame retardancy similar to that of commercially available modacrylic fibers (LOI: 23 to 26% of $O_2$). However, compared with such fibers the fiber of the invention has very considerable advantages. For instance, it can be produced without special polymers having to be prepared, simply on the basis of the acrylonitrile polymers standardized in DIN No. 60,001, it merely being necessary to admix these with an additive having flame-retardant properties without the spinning technique having to be changed in any way. The result is a significantly simpler process. Nor is it necessary to change the aftertreatment of the fiber.

The fibers thus produced have a pronounced soft, wool-like hand, and their textile data differ only insignificantly from standard dry-spun polyacrylonitrile fibers. Nor is the combination of flame retardants significantly attacked in the dry-spinning process or in the course of the aftertreatment, or even in subsequent finishing processes, such as desizing, bleaching or dyeing. Even 25 washes at 30° C. and 10 dry-cleaning cycles (perchloroethylene) lead only to slight losses, namely less than 5%, based on additive.

Finally, it should also be emphasized that, although the UV stability of the fiber of the invention is somewhat lower than that of standard acrylic fibers, it is still better than that of modacrylic fibers.

The fibers of the invention can therefore be used for any purposes for which standard acrylonitrile fibers are used.

The examples, which follow, contain more detailed data which will further illustrate the present invention.

EXAMPLE 1

A solution having a polyacrylonitrile concentration of 31.5% by weight was prepared from polyacrylonitrile and dimethylformamide at a dissolving temperature of 50° C. This solution was deaerated and then had added at a temperature of 80° C. by means of a metering pump, per 100 g of solution, 31.11 g of a masterbatch consisting of 5.5% by weight of polyacrylonitrile, 31.2% by weight of tris-2,3-dibromopropyl isocyanurate, 3.9% by weight of antimony trioxide and 59.4% by weight of dimethylformamide and was homogeneously distributed by thorough stirring, to give a spinning material of the following composition:

| | |
|---|---|
| Polyacrylonitrile | 25.33% by weight |
| Tris-2,3-dibromopropyl isocyanurate | 7.40% by weight |
| $Sb_2O_3$ | 0.93% by weight |
| Dimethylformamide | 66.34% by weight |
| Viscosity at 90° C. | 10 Pas |

This solution was heated to 90° C. and then spun through a 240-hole spinneret having individual hole diameters of 175 μm into a spinning cell where the gas temperature at the top was 210° C. and at the bottom 100° C. The solution was spun into filaments having cell tow titer of 10.5 to 11 dtex, which were then stretched in a ratio of 1:4.4, washed at the boil and dried at 160° C. The result was a fiber which contained 29.2% by weight of tris-2,3-dibromopropyl isocyanurate and 3.7% by weight of $Sb_2O_3$, based on the polymer content.

The fiber thus obtained had the following textile data: titer 3.5 dtex, tenacity 24 cN/tex, elongation at break 34% and whiteness (basic whiteness without optical brightener) 48 BE. LOI in accordance with ASTM D 2863: 24.5% of $O_2$. The edge flame test in accordance with DIN 53,906 on 150 to 170 g/m² tubes knitted from the fiber gave, on 3 seconds exposure to a flame, a burning time of 4 seconds and a tear length of 62 mm and, on 15 seconds exposure to a flame, a burning time of 0 seconds and a tear length of 69 mm.

The textile data of a staple fiber produced therefrom and of a woven fabric prepared from this staple fiber were compared with the data of a standard acrylic fiber. The data are recorded in Tables 1 and 2, below.

TABLE 1

Textile data of staple fiber compared with a standard polyacrylonitrile fiber (delustered with 0.4% of $TiO_2$)

| | Titer dtex n = 100 | Tenacity cN/tex n = 100 | Elongation at break % n = 100 | Dry modulus cN/tex/% n = 50 | Knot strength cN/tex n = 50 | Boil shrinkage % n = 20 | Whiteness BE n = 5 |
|---|---|---|---|---|---|---|---|
| Fiber of Example 1 | 3.4–3.7 | 24–25 | 33–34 | 2.6–2.9 | 13–14 | 1.2 | 48 |
| Standard | 2.9–3.3 | 25–26 | 34–35 | 4.0–4.7 | 17–18 | 1.0 | 52 |

TABLE 2

Textile data of a woven fabric compared with those of a standard polyacrylonitrile fiber Weight: 135 g/m²

| | Tensile strength N | | Elongation at break % | | Tongue tear strength N | | Tear propagation strength N | | Bursting strength mm | | Abrasion resistance (hole forms after x minutes) |
|---|---|---|---|---|---|---|---|---|---|---|---|
| | Warp | Weft | Warp | Weft | Warp | Weft | Warp | Weft | Height of vault | bar | |
| Fibers of Example 1 | 410 | 460 | 18 | 30 | 55 | 48 | 22 | 20 | 25 | 2.8 | 11 |
| Standard | 455 | 480 | 20 | 28 | 37 | 32 | 18 | 16 | 25 | 3.5 | 12 |

Fibers containing 20, 30 or 40% by weight of tris-2,3-dibromopropyl isocyanurate as well as no, or varying amounts of, antimony trioxide were prepared in a similar manner. All these fibers were tested in respect of their textile data and subjected to the abovementioned flame tests. The results are summarized in Table 3, below. The stated whiteness of the fibers is the basic whiteness without optical brighteners. For comparison, the values are given of an acrylic fiber which is free of additives of the invention but which, to make it comparable, contains 0.4% by weight of $TiO_2$.

TABLE 3

| Tris-2,3-dibromopropyl isocyanurate/ $Sb_2O_3$ (based on PAC) % by weight | Textile data: Titer dtex | Tenacity cN/tex | Elongation at break % | Whiteness (BE) | ASTM D 2863 (LOI) % $O_2$ | Flame retardancy determined on knitted tubes (about 150 to 170 g/m²) DIN 53,906 (edge flame test): after a 3 seconds igniting time: burning time seconds | tear length mm | after a 15 seconds igniting time: burning time seconds | tear length mm |
|---|---|---|---|---|---|---|---|---|---|
| Sample without additive, for comparison | 3.3 | 25 | 30 | 52 | 18 | * | — | * | — |
| 30/0 | 3.6 | 22 | 30 | 50 | 23 | 22 | 120 | 0 | 75 |
| 30/6 | 3.5 | 24 | 31 | 48 | 25 | 7 | 60 | 0 | 75 |
| 40/4 | 3.5 | 23 | 32 | 47 | 25 | 1 | 58 | 0 | 87 |
| 40/0 | 3.7 | 21 | 32 | 49 | 24 | 2 | 55 | 0 | 80 |
| 20/6 | 3.9 | 23 | 41 | 48 | 23 | 17 | 95 | 3 | 100 |

*Sample burns up

EXAMPLE 2

A polyacrylonitrile fiber containing 30% by weight of tris-2,3-dibromopropyl isocyanurate and 4% by weight of antimony trioxide and 2% by weight of zinc oxide as synergists was produced analogously to the manner described in Example 1. The fiber thus obtained had a titer of 3.3 dtex, a tenacity of 23 cN/tex, an elongation at break of 29% and a whiteness of 50 BE. The LOI in accordance with ASTM D 2863 was 26% of $O_2$, ie. better than that of a fiber which, in addition to the 30% of the bromine compound, contains 6% of $Sb_2O_3$ as sole synergist.

If the zinc oxide is replaced by the same amount of zinc phosphate as second synergist, the LOI is 25% of $O_2$.

EXAMPLE 3

A fiber containing 30% by weight of tris-2,3-dibromopropyl isocyanurate and 2% by weight of zinc oxide was produced in the manner described in Example 1 from polyacrylonitrile and dimethylformamide with the addition of a masterbatch of suitable composition. The LOI of the fiber thus produced is 24% of $O_2$.

If the zinc oxide is replaced by 4% by weight of zinc phosphate or 4% by weight of a magnesium compound (Frimis MZ 3 which is a basic magnesium silicate of the formula $Mg[Si_4O_{10}](OH)_2$ from Messrs. Calcit Fullstoff GmbH, Cologne) the LOI is 23.5% of $O_2$.

EXAMPLE 4

A polyacrylonitrile fiber was dry-spun from polyacrylonitrile in the manner described in Example 1, the flame retardant added being 30% by weight of tris-2,3-dibromopropyl isocyanurate and the synergist added being 4% by weight of a molybdenum/zinc compound (Kemgard 911 A from Messrs. Lehmann und Voss which has the following approximate composition in percent by weight:

| | |
|---|---|
| $MoO_3$ | 8.8 |
| ZnO | 10.7 |
| *$CaCO_3$ | 72.1 |
| $SiO_2$ | 3.4 |
| CaO | 0.7 |
| $H_2O$ | 3.4 |

*may be partially present as calcium silicate.

). The fiber thus produced combined excellent UV stability with an LOI of 24% of $O_2$. If 2% by weight of zinc oxides are also added, the LOI can be increased to 25% of $O_2$.

If the second synergist used is 2% by weight of a magnesium compound (Frimis MH 3 from Messrs. Calcit Fullstoff GmbH), in place of ZnO, the LOI rises to 26% of $O_2$.

EXAMPLE 5

A polyacrylonitrile fiber was dry-spun from polyacrylonitrile in the manner described in Example 1, the flame-retardant additive added being 30% by weight of tris-2,3-dibromopropyl isocyanurate and the mixture of synergists added consisting of 4% by weight of antimony trioxide and 2% by weight of a molybdenum/-zinc compound (Kemgard 911 A). The LOI of the fiber is 26% of $O_2$.

What we claim is:

1. A flame-retardant polyacrylonitrile fiber comprising a parent polymer with an acrylonitrile content of at least 85% by weight and 15 to 40% by weight based on the polymer of tris-2,3-dibromopropyl isocyanurate, said fiber being prepared by the so called "dry spinning method".

2. The polyacrylonitrile fiber claimed in claim 1, which contains 25–40% by weight of tris-2,3-dibromopropyl isocyanurate, based on the polymer.

3. The polyacrylic fiber claimed in claim 1, which also contains an acid acceptor.

4. The polyacrylic fiber claimed in claim 1, which contains up to 10% by weight, based on the polymer, of one or more substances which act synergistically with the flame retardant and are selected from the group consisting of antimony oxide, molybdenum oxide, zinc oxide, zinc phosphate, magnesium oxide and basic magnesium silicate.

5. The polyacrylic fiber claimed in claim 4, in which the amount of synergistic substance is 2 to 6% by weight, based on the polymer.

6. The polyacrylic fiber claimed in claim 4, which contains a mixture of 2 synergistic compounds, of which one is an acid acceptor.

7. The polyacrylic fiber claimed in claim 6, which contains as mixture of two synergists a mixture of antimony oxide, with zinc oxide as acid acceptor, in which the proportion of antimony oxide is larger than that of zinc oxide.

8. The polyacrylic fiber claimed in claim 7, in which the total content of synergistic substances is 6% by weight, based on the polymer, and the zinc oxide content is 2% by weight, based on the polymer.

* * * * *